US007726996B2

(12) United States Patent
Burris et al.

(10) Patent No.: US 7,726,996 B2
(45) Date of Patent: Jun. 1, 2010

(54) COMPRESSION SEAL FOR COAXIAL CABLE CONNECTOR AND TERMINAL

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/637,556

(22) Filed: Dec. 12, 2006

(65) Prior Publication Data

US 2008/0139028 A1 Jun. 12, 2008

(51) Int. Cl.
*H01R 13/52* (2006.01)

(52) U.S. Cl. ..... 439/271; 439/587

(58) Field of Classification Search ..... 439/271–273, 439/278, 281, 587, 732
See application file for complete search history.

(56) References Cited

U.S. PATENT DOCUMENTS

| | | | | |
|---|---|---|---|---|
| 1,840,312 | A * | 1/1932 | Dunmire | 277/622 |
| 3,408,450 | A | 10/1968 | Kleinfelder | 174/21 |
| 3,683,315 | A * | 8/1972 | Kelly | 439/141 |
| 3,874,761 | A | 4/1975 | Stauffer | 339/60 R |
| 4,305,638 | A | 12/1981 | Hutter | 339/177 R |
| 4,702,710 | A | 10/1987 | Dittman et al. | 439/271 |
| 4,722,579 | A | 2/1988 | Cummings et al. | 439/391 |
| 5,266,045 | A | 11/1993 | Yamamoto et al. | 439/275 |
| 5,527,188 | A | 6/1996 | Ohtaka et al. | 439/587 |
| 5,571,028 | A | 11/1996 | Szegda | 439/322 |
| 5,616,046 | A | 4/1997 | Sundstrom et al. | 439/367 |
| 5,667,405 | A | 9/1997 | Holliday | 439/585 |
| 5,857,865 | A | 1/1999 | Shimirak et al. | 439/277 |
| 6,261,110 | B1 * | 7/2001 | Hatazawa | 439/141 |
| 6,929,265 | B2 | 8/2005 | Holland et al. | 277/622 |
| 7,011,535 | B2 * | 3/2006 | Dickie | 439/141 |
| 7,097,500 | B2 * | 8/2006 | Montena | 439/587 |
| 2004/0175983 | A1 | 9/2004 | Davis | 439/369 |
| 2005/0176294 | A1 | 8/2005 | Montena | 439/587 |
| 2007/0123101 | A1 | 5/2007 | Palinkas | 439/579 |

FOREIGN PATENT DOCUMENTS

| | | |
|---|---|---|
| GB | 1 294 510 | 11/1972 |

* cited by examiner

*Primary Examiner*—Tho D Ta
*Assistant Examiner*—Travis Chambers
(74) *Attorney, Agent, or Firm*—Joseph M. Homa; Matthew J. Mason

(57) ABSTRACT

A compression seal for a coaxial cable connector has a main body with an upward facing surface or flange on the outer surface thereof, the upward facing surface or flange facing away from the main body. The outer surface of the main body also has at least one first portion having a first diameter and at least one second portion having a second diameter, the first diameter being smaller than the second diameter. The compression seal may also have an outer body that receives the main body and also engages a connector at both ends.

18 Claims, 9 Drawing Sheets

COMPRESSION SEAL FOR COAXIAL CABLE CONNECTOR AND TERMINAL

BACKGROUND OF THE INVENTION

1. Field of the Invention

The present invention relates generally to compression seals for coaxial cable connectors, and particularly to seals for sealing gaps at interfaces between coaxial cable connectors and terminals.

2. Technical Background

Coaxial cable connectors such as F-connectors are used to attach a coaxial cable to another object such as an appliance or junction having a terminal adapted to engage the coaxial cable connector. When used outdoors in weather-exposed areas it is desirable to prevent moisture from entering the terminal/connector/cable system. Various connectors are commercially available for outdoor applications and generally prevent moisture from entering the connector/cable junction. Such connectors must be attached to a coaxial cable using various cable preparation techniques and installation tools. Cable preparation typically requires removal of portion of the cable jacket, braid, outer conductor and core to expose the cable center conductor. Another portion of the cable jacket is removed to expose the cable braid. Cable preparation is often completed by folding of the cable braid structure back against the remaining cable jacket. The cable is then inserted into the connector, after which the connector is activated to secure the connector to the coaxial cable. For outdoor applications the connector is generally sealed to the cable either by the internal workings of the connector or by the use of an external sealant, heat shrinkable tubing, rubber cement, fusing tape or rubberized boot.

In order to maintain the integrity of the coaxial system, moisture must be prevented from entering the connector/appliance junction as well. In the past, others have attempted to provide a connector/appliance seal by using a rubber type material in the form of a tight fitting ring with an inner bore and an outer diameter or shape. For various reasons, the foregoing attempts have yielded less than satisfactory results. For example, attempts at encapsulating the connectors with tapes, shrink % wrappings and plastic or rubber cements are too prone to installation errors, resulting in exposed seams and/or internal voids where moisture can collect and eventually penetrate to the cable junction. Moreover, shrink wrappings require the use of heat or chemicals which further complicate installation procedures. Cements require time to set up and cure, thus also prolonging and complicating installation procedures. The use of sealing components such as externally applied flexible boots and/or grommets again results in internal voids where moisture can collect. Installation of tight fitting seal rings is difficult and therefore many times is avoided. Subsequent removal of tight fitting seal rings after a lengthy period of service can be even more difficult than installation and oftentimes requires the use of a knife or similar instrument to cut the seal ring off of the appliance junction. This can likely result in damage to the junction threads and is not desirable. Additionally, existing seal rings are limited in use by the length of terminal port on which they are installed. A specific length seal ring must be matched with and installed on a terminal port of compatible length, thereby requiring the technician to recognize various port lengths and have a correct assortment of seal rings on hand. One example of a known seal ring is illustrated in FIG. 1. As illustrated, a seal ring 10 typically has a smooth outer surface 12 and a first internal bore 14 that is slightly smaller than the diameter of the threaded section 16 of terminal 18.

Terminal 18 projects out from a wall surface, for example the exterior surface of an electrical or electronic device. This seal ring 10 also has a second internal bore 20 that has a diameter slightly smaller than the coupling nut 22 associated with coaxial cable connector 24. In this manner, a tight seal may be achieved by the tight fit between the seal ring 10 and, at each end, the coupling nut 22 and the threaded section 16 of terminal 18.

However, this and many of the known seal rings cover substantially most of the threads on the appliance port and require that at least a portion of the corresponding cable connector coupler engage the seal ring while engaging the port threads. This engagement of the seal ring can cause difficulty in turning the connector coupler, making the connector hard to install.

It would be desirable therefore to provide a terminal/connector junction sealing device that is easily installed, reliable, economical, easily removable, cover a range of terminal port lengths and allow easier turning of the connector coupler during installation.

SUMMARY OF THE INVENTION

Disclosed herein is a compression seal for a coaxial cable connector for preventing moisture from entering an interface between a cable connector and a terminal, the compression seal including a main body having a first end, a second end, an outer surface, and an inner surface, the inner surface defining an opening extending through the main body between the first and second ends, and an upward facing surface on the outer surface at the first end, the upward facing surface also generally facing away from the main body, wherein the outer surface of the main body has at least one first portion having a first diameter and at least one second portion having a second diameter, the first diameter being smaller than the second diameter.

In some embodiments, a compression seal is disclosed herein for sealing an interface between a coaxial cable connector and a terminal, the terminal having a maximum outer diameter, the compression seal comprising a compressible main body having a minimum inner diameter smaller than the maximum outer diameter of the terminal. In some embodiments, the terminal has an total axial length, and the main body has a total axial length shorter than the total axial length of the terminal. In some embodiments, the main body comprises a bellows portion. The bellows portion can comprise a plurality of peaks having substantially equal first maximum outer diameters in an uncompressed state, wherein the plurality of peaks have substantially equal second maximum outer diameters in a compressed state; in some embodiments, the first maximum outer diameters are substantially equal to the second maximum outer diameters. The bellows portion can also comprise a plurality of valleys having substantially equal first minimum inner diameters in an uncompressed state, and the plurality of valleys have substantially equal second minimum outer diameters in a compressed state; in some embodiments, the first minimum outer diameters are substantially equal to the second minimum outer diameters.

In some embodiments, the main body comprises a tapered flange disposed at an end of the main body. In other embodiments, the main body comprises a first tapered flange disposed at one end of the main body, and the main body comprises a second tapered flange disposed at an opposite end of the main body.

In preferred embodiments, the main seal body is axially compressible.

In some embodiments, the terminal comprises a threaded portion. In some embodiments, the coaxial cable connector is capable of threadedly engaging the threaded portion before the connector contacts the main body.

In some embodiments, the coaxial cable connector is capable of compressing the main body, wherein the coaxial cable connector is capable of threadedly engaging the threaded portion, and the coaxial cable connector is capable of threadedly engaging the threaded portion before the connector compresses the main body.

In some embodiments, the connector is capable of engaging the terminal before the connector contacts the main body.

In some embodiments, the connector is capable of threadedly engaging the terminal before the connector compresses the main body.

In some embodiments, the compression seal further comprises an outer body, the outer body comprising an inner surface defining an opening therein configured to receive the main body.

A method of sealingly engaging a coaxial cable connector to a terminal is also disclosed herein, the method comprising: sliding a main seal body onto the terminal; then, engaging the terminal with the connector without the connector contacting the main seal body; then, compressing the main seal body with connector.

In some embodiments, the main body has an upward facing surface that is disposed at the second end of the main body and generally faces away from the main body.

In some embodiments, the seal also includes an outer body into which the main body is frictionally disposed.

In another aspect, a compression seal for a coaxial cable connector for preventing moisture from entering an interface between a cable connector and a terminal is disclosed that includes a main body having a first end, a second end, an outer surface, and an inner surface, the inner surface defining an opening extending through the main body between the first and second ends and the outer surface of the main body having at least one first portion having a first diameter and at least one second portion having a second diameter, the first diameter being smaller than the second diameter, an upward facing surface on the outer surface at the first end, the upward facing surface also generally facing away from the main body, and an outer body, the outer body having an outer surface, an inner surface, a first end, and a second end, the inner surface defining an opening therein to frictionally receive the main body and the first and second ends configured to engage a connector.

In yet another aspect, disclosed herein is a combination of a compression seal and coaxial cable connector for coupling an end of a coaxial cable to a terminal, the compression seal preventing moisture from entering therein, the compression seal including a main body having a first end, a second end, and an inner surface, the inner surface defining an opening extending through the main body between the first and second ends to receive at least a portion of the terminal therein, and an outer surface on the main body, the outer surface having at least one first portion having a first diameter and at least one second portion having a second diameter, the first diameter being smaller than the second diameter, wherein at least a portion of the main body is disposed between a front end of the coaxial cable connector and the terminal when the coaxial cable connector is connected to the terminal Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
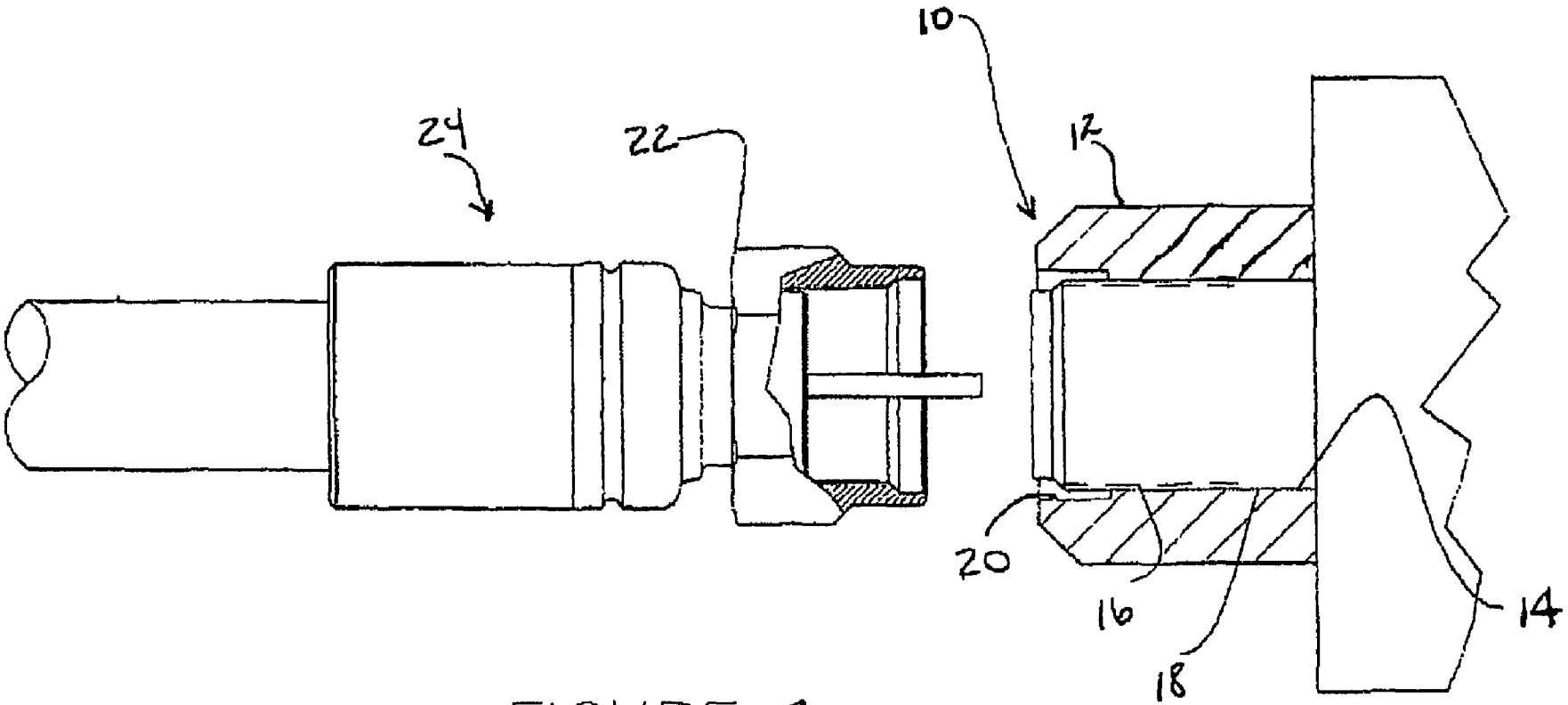
FIGURE 1 (PRIOR ART)
FIG. 1 illustrates in partial cross section a prior art seal installed on a terminal with a coaxial cable connector positioned to be connected to the terminal.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
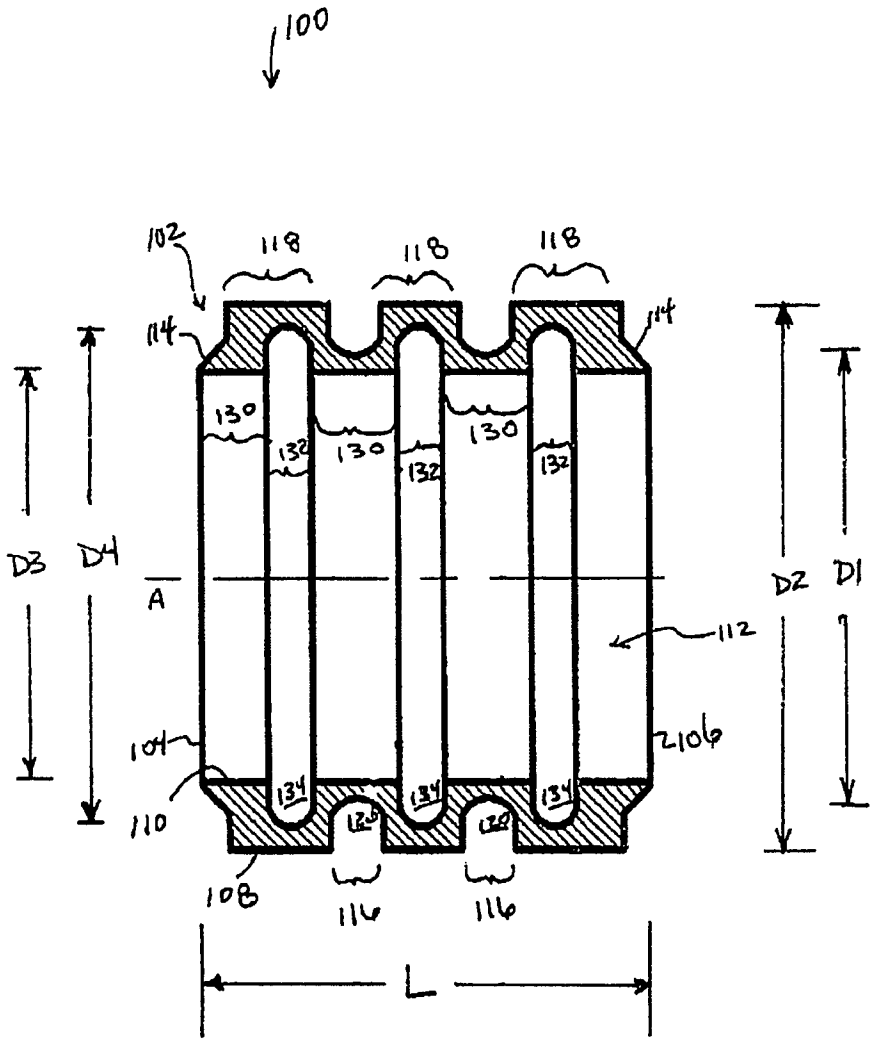
FIG. 2 is a cross sectional view of one embodiment of a compression seal as disclosed herein.

Referring to FIG. 2, the seal member 100 comprises a main body 102 having first end 104, a second end 106, and outer surface 108, and an inner surface 110. The inner surface 110 defines an opening 112 extending between the first end 104 and the second end 106 and has a longitudinal axis A. The outer surface 108 preferably includes an upward facing surface or tapered flange 114 at each of the first and second ends 104,106. The main body 102 has an axial length L. The seal member 100 is preferably molded from a plastic material, such as HDPE or any similar material, and is preferably treated to resist the deleterious effects of ultraviolet light on plastic. However, any other appropriate materials may be used.

The outer surface 108 has at least one first portion 116 that has a first minimum outer diameter D1 and at least one second portion 118 that has a second maximum outer diameter D2, where D1 is smaller than D2. The first portion 116 has reduced diameter D1 as a result of a circumferential groove 120 that extends around the main body 102. In fact, in this embodiment, there are two circumferential grooves 120, although there may be fewer or more. While a groove 120 is illustrated, any appropriately shaped depression in the first portion 116 that reduces the diameter of the outer surface 108 may be used. For example, the groove 120 may be v-shaped, or cause a sinusoidal shape in the outer surface 108.

The second portion 118 of outer surface 108 preferably has a substantially constant outer diameter surface, but may, as indicated above, also be curved when, for example, the first and second portions 116,118 have a sinusoidal shape. Other shapes for the second portion 118 are also possible.

The inner surface 110 preferably also has at least one first portion 130 and at least one second portion 132. In the present embodiment there are five first portions 130 and three second portions 132, although there may be more or fewer of each. The first portion 130 has a first minimum inner diameter D3 that is smaller than the second maximum inner diameter D4 of the second portion 132. Similar to the outer surface 108, the second portions 132 of inner surface 110 each have a circumferential groove 134 that causes the inner surface 110 to have a larger diameter D4, although any appropriate shape may be used with the second portions 132.

As illustrated best in FIG. 2, the circumferential grooves 120,134 are axially spaced from one another along the longitudinal axis A, thereby allowing the seal member 100 to be axially compressed or elongated while the second portions 118 and the first portions 130 retain substantially common maximum outer diameters D2 and minimum inner diameters D3, respectively. In the non-installed uncompressed state (FIG. 2), the seal member 100 has an axial length L, but once installed, the seal member 100 may be elongated to a longer axial length to cover the junction of the coaxial cable connector and terminal (or a second coaxial cable connector) or, the seal member 100 is axially compressed to ensure a tight seal to prevent moisture from entering the interface of the connection. In this case, the seal member 100 would have a shortened axial length LS, as illustrated in FIG. 4 and discussed below.

Figure 3:
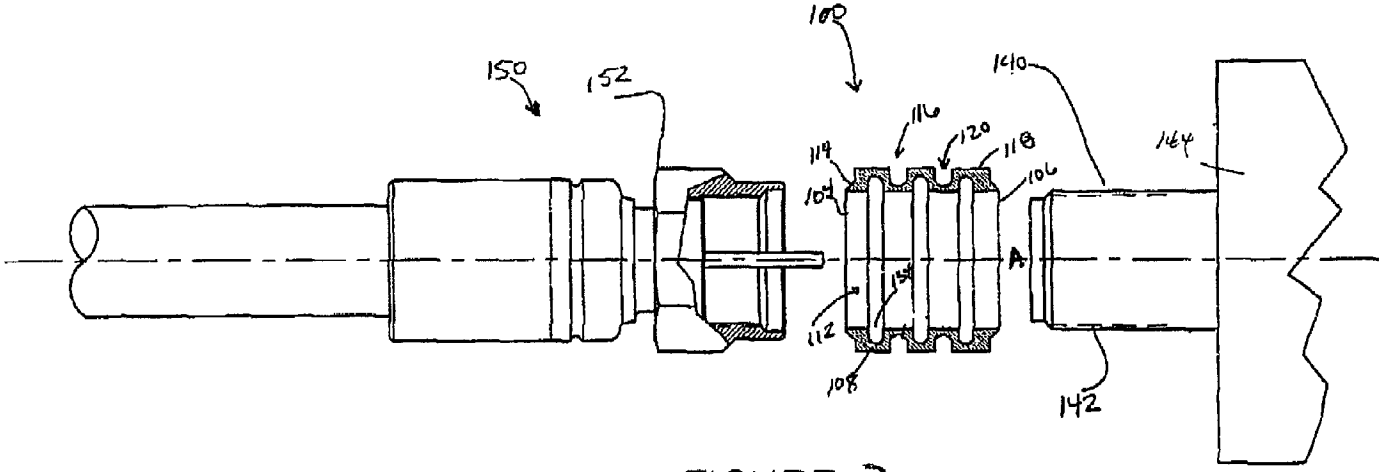
FIG. 3 is a cutaway view of one embodiment of the compression seal of FIG. 2 prior to installation onto a coaxial cable connector and a terminal.
Figure 4:
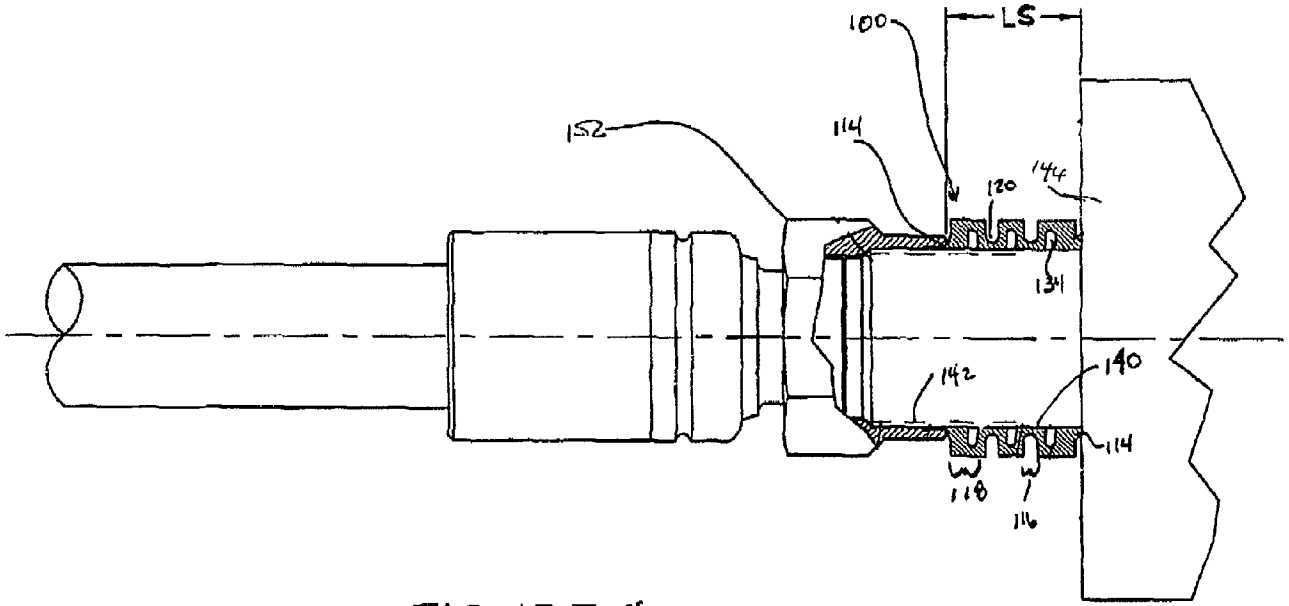
FIG. 4 is a cutaway view of the compression seal of FIG. 2 fully installed on a terminal.

Referring to FIGS. 2, 3, and 4 the seal member 100 can be placed over the terminal 140. The diameter D3 is slightly larger than the diameter of the terminal 140 and particularly the threaded portion 142, allowing the seal member 100 to be easily placed over the terminal 140. In some embodiments the axial length L of seal member 100 is slightly shorter than the axial length of terminal 140, thereby allowing the coaxial cable connector 150 to engage the threaded portion 142 of terminal 140.

As seen in FIG. 4, as the coaxial cable connector 150, and particularly coupling nut 152, is threaded onto the threaded portion 142 of terminal 140, the coaxial cable connector 150 compresses seal member 100 against the surface 144 of apparatus or device from which the terminal 140 extends, causing the seal member 100 to shorten to a length LS. The axial shortening of the seal member 100 is facilitated by the grooves 120,134 allowing the compression of the seal member 100. At the same time, the upward facing surface or tapered flange 114 at first end 104 is in position between the coupling nut 152 and the threaded portion 142 of the terminal 140 thereby helping to seal the connection against moisture. The upward facing surface or tapered flange 114 at second end 106 also engages the terminal 140 and the base surface 144 of the device or apparatus from which the terminal 140 protrudes, such that the second end 106 seals the surface 144 supporting the terminal 140. In some embodiments, the compression of seal member 100 also causes the inner surface 110 to move radially inward and engage the terminal 140 (except where the grooves 134 are located) providing further protection from moisture ingress. Thus, the first portions 130 have smaller substantially common minimum diameters in the compressed state as compared to the uncompressed state. Also, the second portions 118 have substantially common maximum diameters in the compressed state as well as in the uncompressed state.

Figure 5:
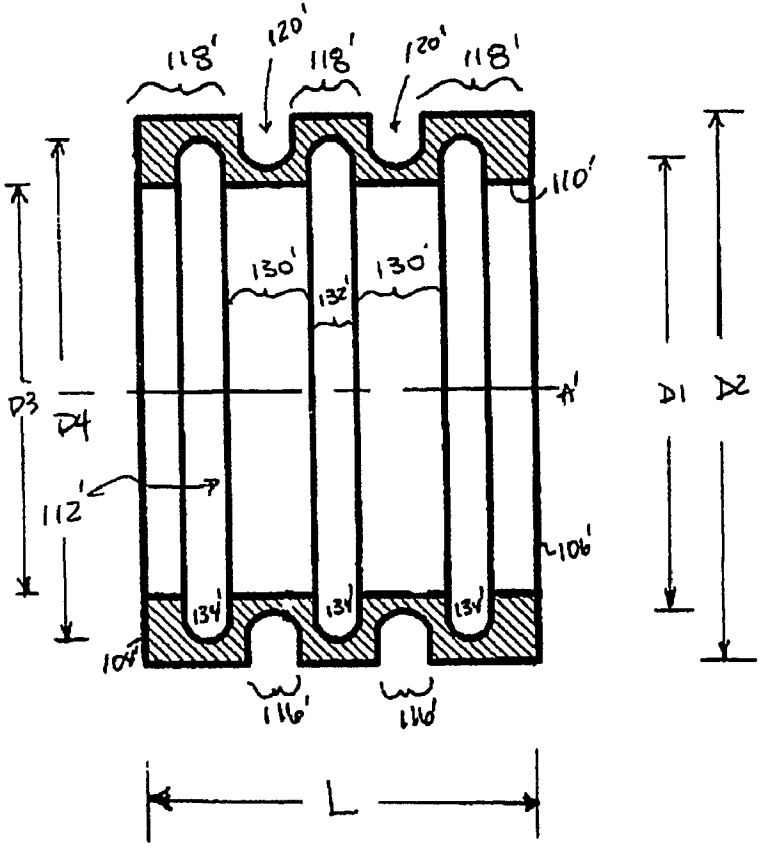
FIG. 5 is a cross sectional view of another embodiment of a compression seal as disclosed herein.

An alternative embodiment of seal member 100' is illustrated in FIG. 5. The seal member 100' also a main body 102' having first end 104', a second end 106', and outer surface 108', and an inner surface 110'. The inner surface 110' defines an opening 112' extending between the first end 104' and the second end 106' and has a longitudinal axis A'.

The outer surface 108' has at least one first portion 116' that has a first minimum outer diameter D1 and at least one second portion 118' that has a second maximum outer diameter D2, where D1 is smaller than D2. The first portion 116' has reduced diameter D1 as a result of a circumferential groove 120' that extends around the main body 102'.

The second portion 118' of outer surface 108' preferably has a relatively flat surface, but may, as indicated above, also be curved when, for example, the first and second portions 116',118' have a sinusoidal shape. Other shapes for the second portion 118' are also possible.

The inner surface 110' preferably also has at least a first portion 130' and a second portion 132'. In the present embodiment there are three first portions 130' and five second portions 132', although there may be more or fewer of each. The first portion 130' has a first minimum inner diameter D3 that is smaller than the second maximum inner diameter D4 of the second portion 132'. Similar to the outer surface 108', the second portions 132' of inner surface 110' each have a circumferential groove 134' that causes the inner surface 110' to have a larger diameter D4, although any appropriate shape may be used with the second portions 132'.

However, seal member 100' does not have the upward facing surfaces or tapered flanges. However, the seal member 100' still will have a portion of the main body 102' that becomes positioned between the coupling nut 152 and the threaded portion 142 of the terminal 140. The seal member is compressively positioned between the coupling nut 152 and the terminal 140, sealing the interface.

Figure 6:
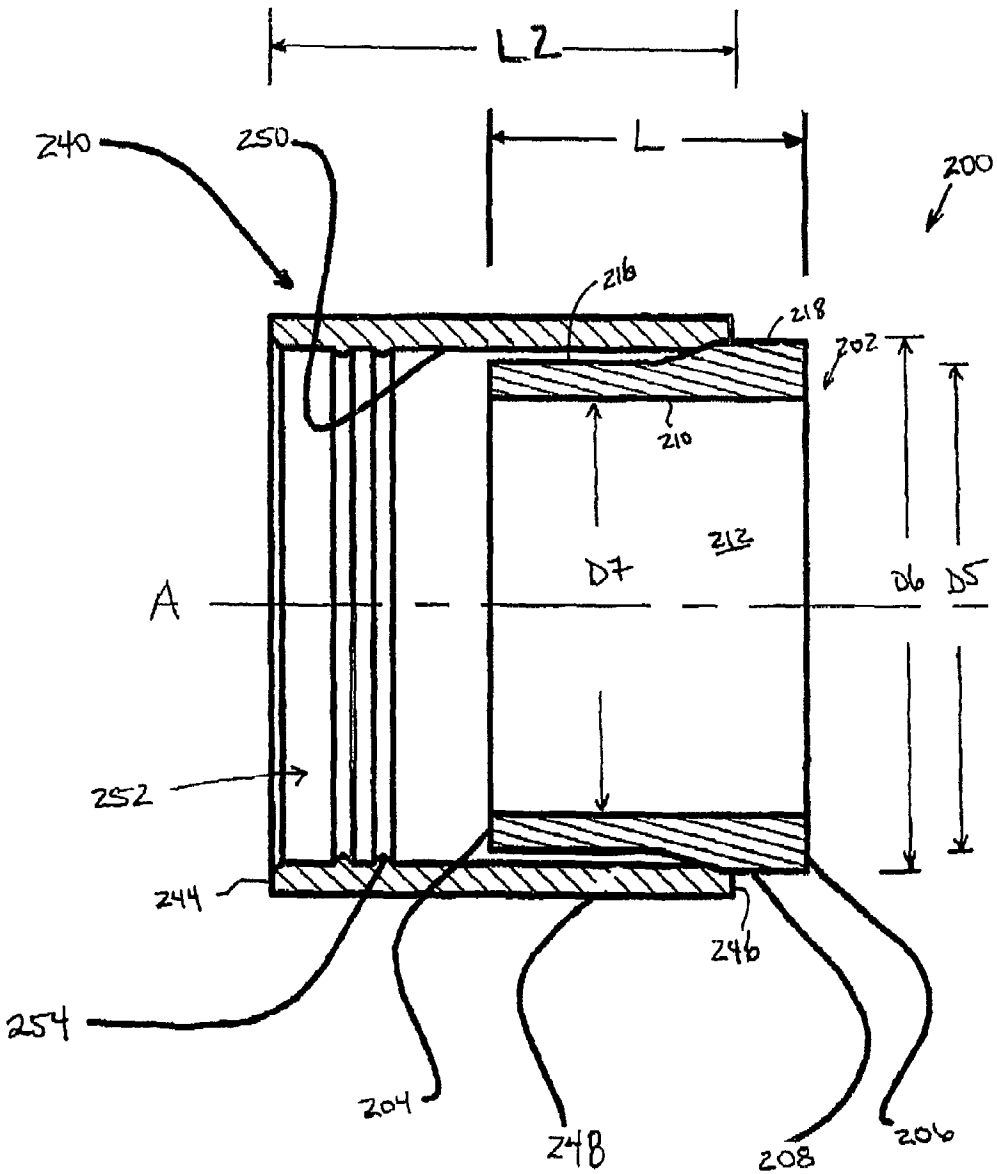
FIG. 6 a cross sectional view of another embodiment of compression seal as disclosed herein.
Figure 7:
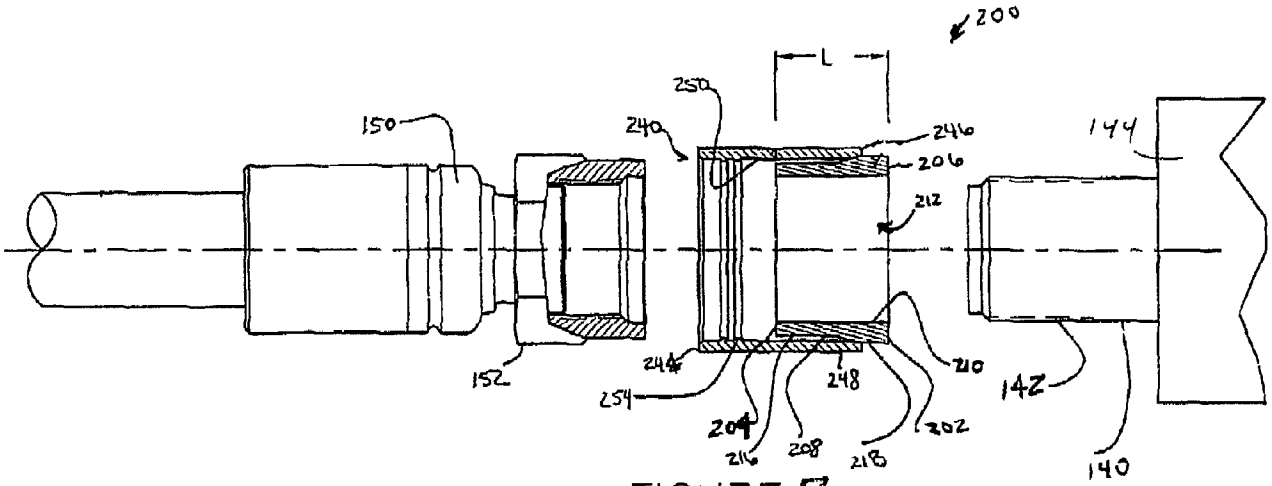
FIG. 7 is a cutaway view of one embodiment of compression seal of FIG. 6 prior to installation onto a coaxial cable connector and a terminal.
Figure 8:
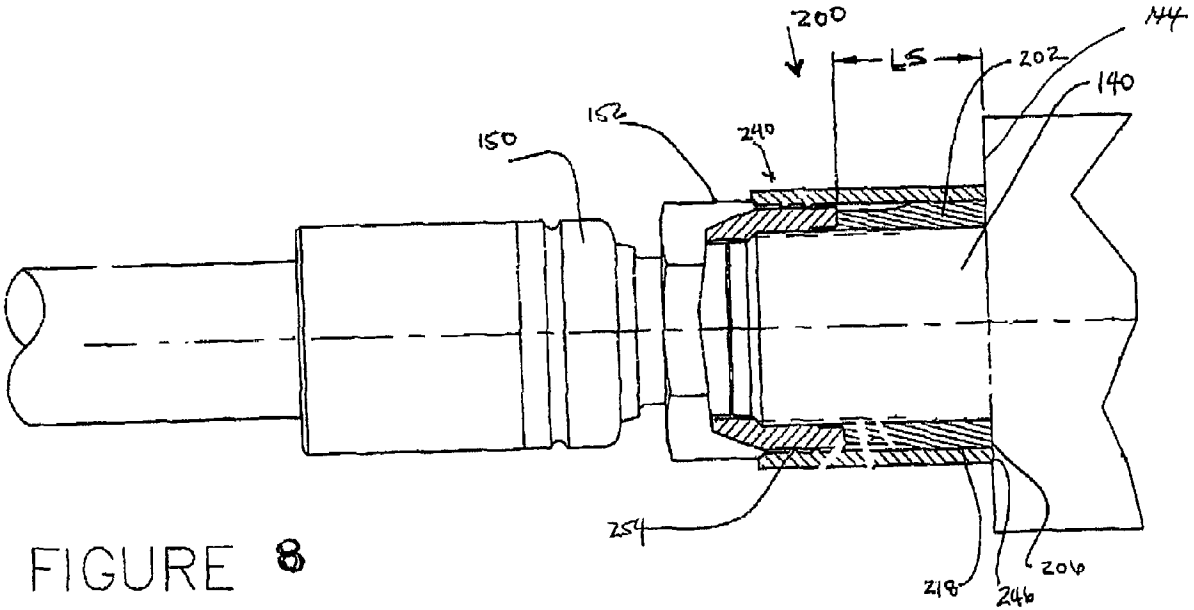
FIG. 8 is a partial side cutaway view of the compression seal of FIG. 6 fully installed to seal the interface of the coaxial cable connector and the terminal.

Another embodiment of a seal member 200 according to the present invention is illustrated in FIGS. 6-8. The seal member 200 comprises a main body 202 having first end 204, a second end 206, and outer surface 208, and an inner surface 210. The inner surface 210 defines an opening 212 extending between the first end 204 and the second end 206 and has a longitudinal axis A. The outer surface 208 has at least one first portion 216 that has a first outer diameter D5 and at least one second portion 218 that has a second outer diameter D6, where D5 is smaller than D6. The main body 202 has a length L. The opening 212 preferably has a single constant inner diameter D7 between the first and second ends 204,206. The main body 202 is preferably molded from a plastic material, such as HDPE, EDPM, or any similar material, and is preferably treated to resist the deleterious effects of ultraviolet light on plastic. However, any other appropriate materials may be used.

The diameter D7 of opening 212 of main body 202 is preferably slightly larger than the diameter of the terminal 140 and particularly the threaded portion 142, allowing the seal member 200 to be easily placed over the terminal 140. The axial length L of main body 202 is shorter than the axial length of terminal 140, thereby allowing the coaxial cable connector 150 to engage the threaded portion 142 of terminal 140.

The seal member 200 also has an outer body 240 that has first end 244, a second end 246, and outer surface 248, and an inner surface 250. The inner surface 250 defines an opening 252 extending between the first end 244 and the second end 246 and opening 252 is coaxial with main body 202 along a common longitudinal axis A. The inner surface 250 also preferably has a plurality of inwardly projecting annular rings 254, which are configured to engage an outside portion of coupling nut 152. Two inwardly projecting annular rings 254 are illustrated in the embodiment in FIGS. 6 and 7, but more or fewer are also possible. Outer body 240 is preferably made from a plastic material, such as a reinforced HDPE, Acetal, or other similar material and is treated to resist the deleterious effects of ultraviolet light on plastic. Outer body 240 has an axial length L2, which is longer than the axial length L of main body 202, but in some embodiments about the same length as the terminal 140. The opening 252 in outer body has a diameter that is slightly smaller than the diameter D6 of main body 202, so main body 202 of seal member 200 is frictionally engaged in opening 252 of outer body 240, but is movable within the opening 252 as detailed below. The diameter of opening 252 is also slightly larger than the diameter of front portion of coupling nut 152, so that outer body 250 can engage the outer portion of coupling nut 152.

As illustrated in FIG. 7, the seal member 200 is in a shipped or initial position, in an uncompressed state, with a portion of the main body 202 protruding out from the second end 246 of outer body 240. The seal member 200 is placed over terminal 140 with the second end 206 of main body 202 engaging the terminal 140. As the coupling nut 152 is rotated onto threaded portion 142, the outer body 240 is driven backward toward the surface 144 supporting the terminal 140 and over the main body 202. The main body 202 engages the front portion of coupling nut 152 as it is advanced along the terminal 140, causing the main body 202 to be compressed between the coupling nut 152 and the surface 144 from which the terminal 140 extends and reducing the axial length of main body 202 to an axial length of LS. The compression of main body 202 preferably causes it to radially expand, providing a seal between the main body 202 and the outer body 240, between the main body 202 and terminal 140, and between the main body 202 and coupling nut 152. As seen in FIG. 8, simultaneously with the axial compression, the outer body 240 engages both the outer surface of the coupling nut 152, preferably with inwardly projecting annular rings 254, and the surface 144 from which the terminal 140 extends with the second end 246 of outer body 240, providing additional seals at these points.

Figure 9:
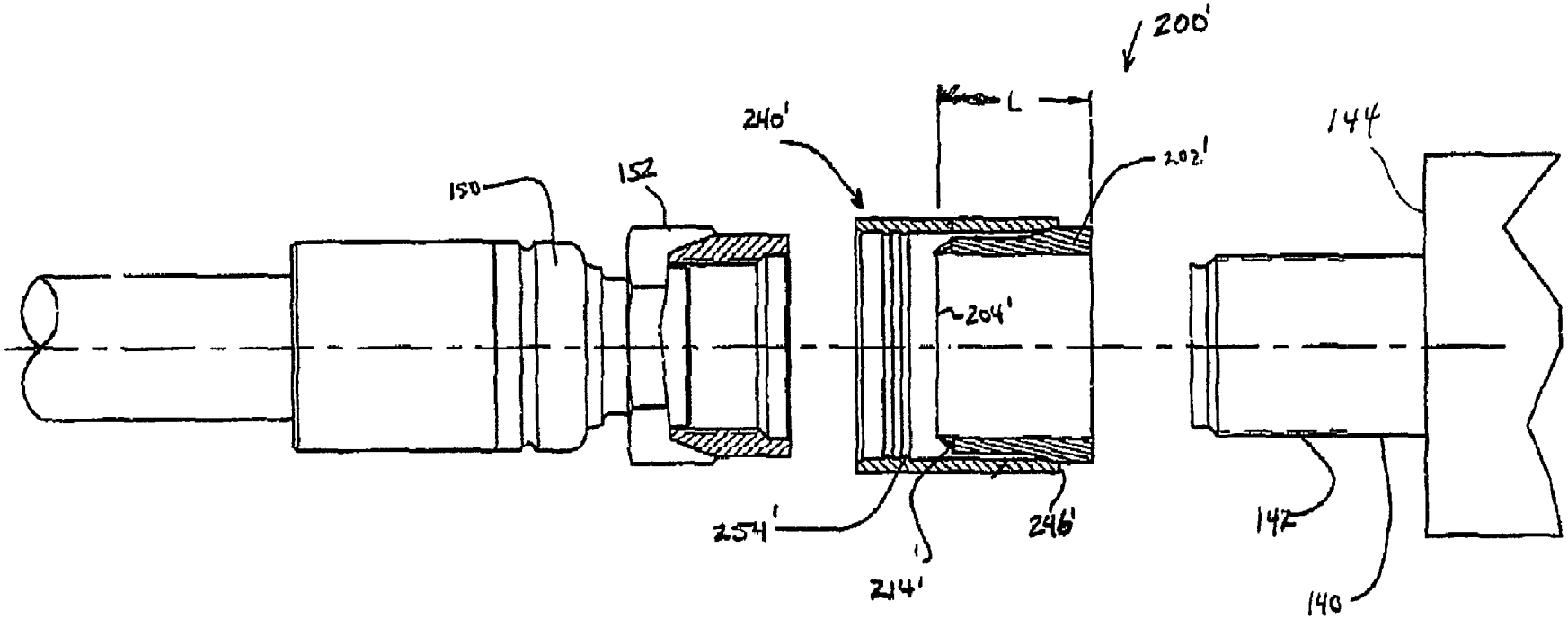
FIG. 9 is a cutaway view of another embodiment of compression seal as disclosed herein prior to installation onto a coaxial cable connector and a terminal.

An alternative embodiment of seal member 200' is illustrated in FIG. 9. In this embodiment, the seal member is similar in construction and operation to seal member 200, but main body 202' includes an upward facing surface or tapered flange 214' at the first end 204'. As the coupling nut 152 is rotated onto threaded portion 142, the outer body 240' is driven backward toward the surface 144 supporting the terminal 140 and the outer body 240' is driven over the main body 202'. The main body 202' engages the front portion of coupling nut 152 as it is advanced along the terminal 140, causing the main body 202' to be compressed between the coupling nut 152 and the surface 144 supporting the terminal 140 and reducing the axial length of main body 202' to a length of LS. The compression of main body 202' causes it to radially expand, providing a seal between the main body 202' and the outer body 240', between the main body 202' and terminal 140 and between the main body 202' and coupling nut 152. The upward facing surface or tapered flange 214' is also positioned between the coupling nut 152 and the threaded portion 142 of the terminal 140 further sealing the connection against moisture. Simultaneously with the axial compression, the outer body 240' engages both the outer surface of the coupling nut 152 with inwardly projecting annular rings 254' and the surface 144 supporting the terminal 140 with the second end 246' of outer body 240', providing additional seals at these points.

Figure 10:
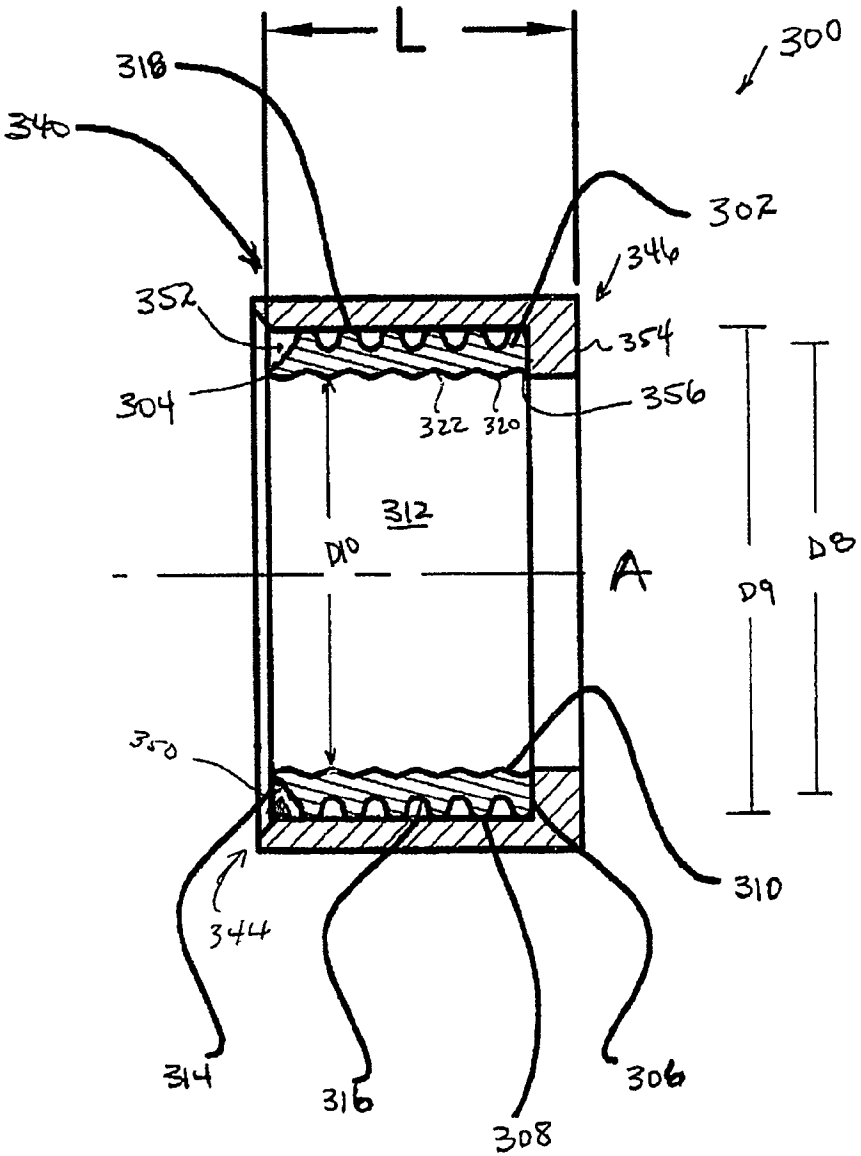
FIG. 10 a cross sectional view of another embodiment of compression seal as disclosed herein.
Figure 11:
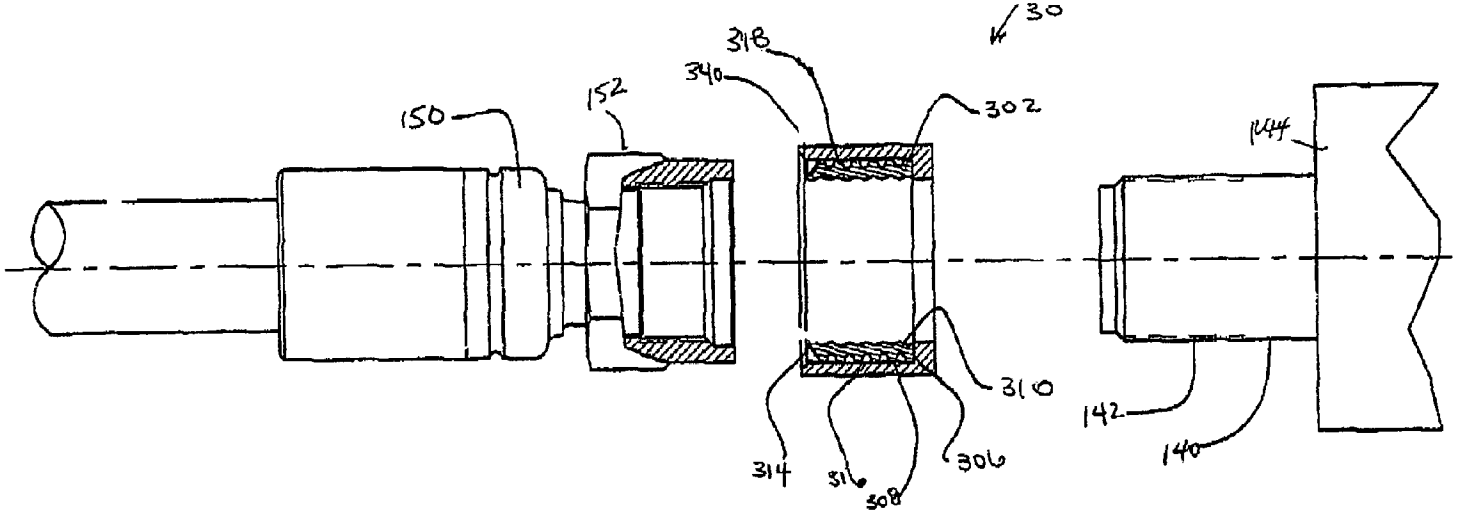
FIG. 11 is a cutaway view of one embodiment of compression seal of FIG. 10 prior to installation onto a coaxial cable connector and a terminal.
Figure 12:
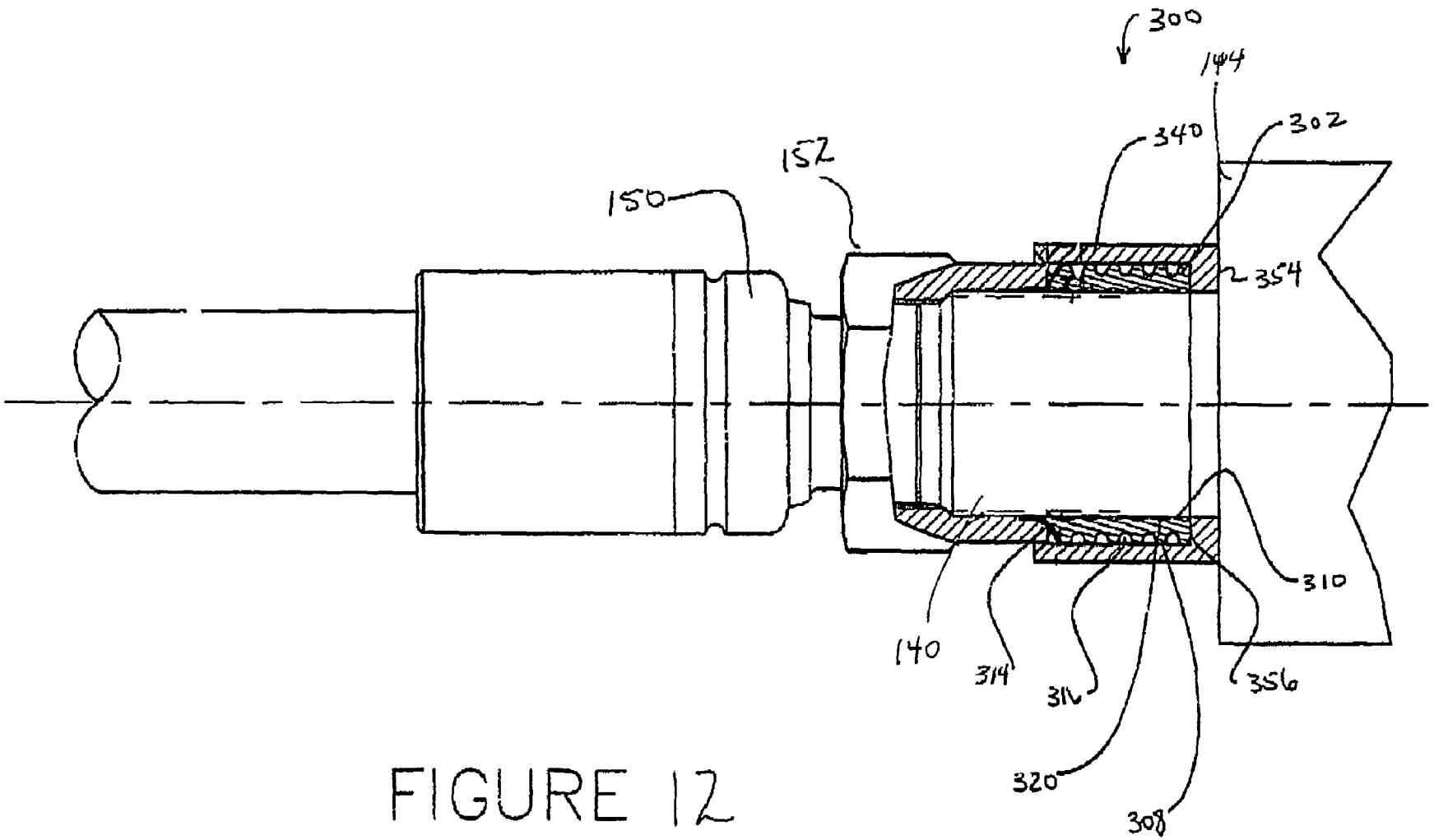
FIG. 12 is a partial side cutaway view of the compression seal of FIG. 10 fully installed to seal the interface of the coaxial cable connector and the terminal.

Another embodiment of a seal member 300 according to the present invention is illustrated in FIGS. 10-12. The seal member 300 comprises a main body 302 having first end 304, a second end 306, an outer surface 308, and an inner surface 310. The inner surface 310 defines an opening 312 extending between the first end 304 and the second end 306 and has a longitudinal axis A. The outer surface 308 preferably includes an upward facing surface or tapered flange 314 at the first end 304. The outer surface 308 has at least one first portion 316 that has a first maximum outer diameter D8 and at least one second portion 318 that has a second maximum outer diameter D9, where D8 is smaller than D9. The seal member 300 has an axial length L. The main body 302 is preferably molded from a plastic material, such as HDPE, EDPM, or any similar material, and is treated to resist the deleterious effects of ultraviolet light on plastic. However, any other appropriate materials may be used.

In the uncompressed state, the inner surface 310 of main body 302 preferably has variable inner diameter such as an undulating configuration, comprising ridges 320 and valleys 322. The minimum inner diameter D10 of opening 312 of main body 302 (i.e. at the narrowest point—at the peak of one of the ridges 320) is slightly larger than the diameter of the terminal 140 and particularly the threaded portion 142, allowing the seal member 300 to be easily placed over the terminal 140. The axial length L of seal member 300 is preferably slightly shorter than the length of terminal 140, thereby allowing the coaxial cable connector 150 to engage the threaded portion 142 of terminal 140 when the seal member 300 is mounted on the terminal 140 and in an uncompressed state. The at least one first portion 316, the at least one second portion 318, and the undulating configuration of the of the inner surface 310 allow the main body 302 to be compressed between the coupling nut 152 and the surface 144 supporting the terminal 140.

The seal member 300 also has an outer body 340 that has first end 344, a second end 346, and outer surface 348, and an inner surface 350. At the second end 346 is an annular flange 354 that provides an inner shoulder 356 against which the main body 302 may be biased. As illustrated in FIG. 12, the outward facing portion of annular flange 354 also engages the surface 144 supporting the terminal 140 to assist with sealing of the interface, as explained in more detail below.

The inner surface 350 of outer body 340 defines an opening 352 extending between the first end 344 and the second end 346 (the opening 352 being reduced at second end 346 because of the annular flange 354) and is coaxial with main body 302 along longitudinal axis A. Outer body 340 is preferably made from a plastic material, such as a reinforced HDPE, Acetal, or other similar material and is treated to resist the deleterious effects of ultraviolet light on plastic. Alternatively, outer body 340 may be constructed of metal, preferably brass or aluminum and preferably treated with a corrosion inhibiting agent, such as nickel plate for an outer body constructed out of brass and/or a chromate conversion coating for an outer body constructed out of aluminum. Outer body 340 preferably has an axial length longer than the axial length of main body 302 so as to completely encapsulate main body 302, i.e. so that main body 302 lies completely within the confines of outer body 340. However, the main body 302 may be shorter or longer relative to the outer body 340, depending on the material and its compressibility. The opening 352 in outer body 340 has a diameter that is slightly smaller than the diameter D9 of main body 302, so main body 302 of seal member 300 is frictionally engaged in opening 352 of outer body 340. The diameter of opening 352 is also slightly larger than the diameter of front portion of coupling nut 152, so that outer body 340 can engage at least a portion of coupling nut 152.

As illustrated in FIGS. 11 and 12, the seal member 300 is in a shipped or initial position in an uncompressed state. The seal member 300 is placed over terminal 140 with the second end 346 of outer body 340 engaging the surface 144 supporting the terminal 140. As the coupling nut 152 is rotated onto threaded portion 142, the main body 302 engages the front portion of coupling nut 152 causing the main body 302 to be compressed between the coupling nut 152 and the annular flange 354 at the second end 346 of outer body 340, compressing main body 302 between the coupling nut 152 and the annular flange 354. The compression of main body 302 causes it to radially expand, providing a seal between the main body 302 and the outer body 340, between the main body 302 and terminal 140, and between the main body 302 and coupling nut 152. Also, the upward facing surface or tapered flange 314 at the first end 304 is positioned between the coupling nut 152 and the threaded portion 142 of the terminal 140 sealing the connection against moisture. Simultaneously with axial compression, the outer body 340 preferably engages both the outer surface of the coupling nut 152 and the terminal 140 with the second end 346, and in particular the annular flange 354, of outer body 340, providing additional seals at these points.

Figure 13:
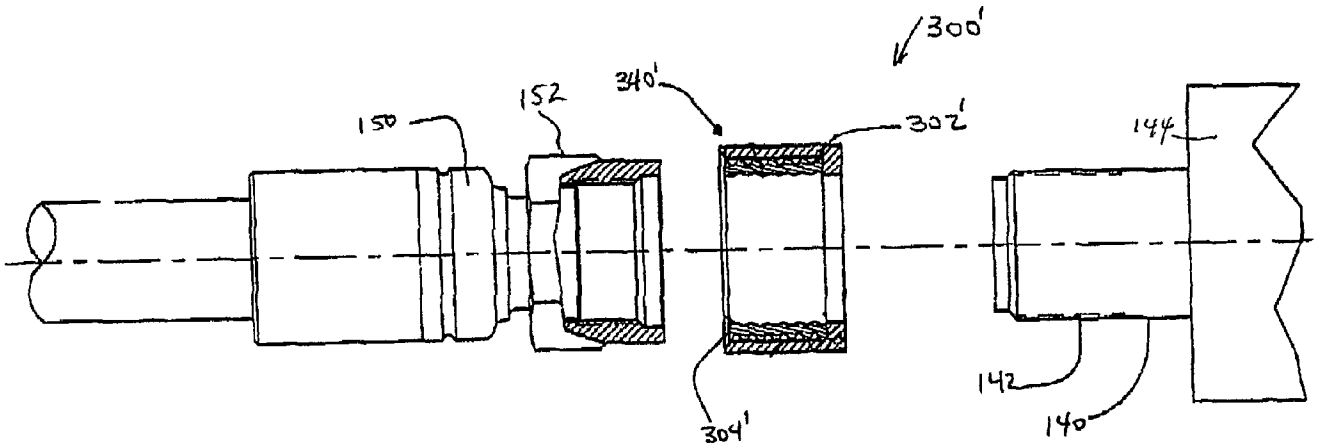
FIG. 13 is a cutaway view of another embodiment of compression seal as disclosed herein prior to installation onto a coaxial cable connector and a terminal.

An alternative embodiment of seal member 300' is illustrated in FIG. 13. In this embodiment, the seal member 300' is similar in construction and operation to seal member 300, but main body 302' does not include the upward facing surface or tapered flange at the first end 304'. Rather, the front end 304' of main body 302' provides an annular surface against which the coupling nut 152 will push to compress the main body 302'. The seal member 302' seals the coaxial cable connector and terminal interface by sealing against the inner surface of the outer body 340', and a portion of the main body 302' may also, depending on the compressibility thereof, become positioned between the coupling nut 152 and the terminal 140.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A compression seal for sealing an interface between a coaxial cable connector and a terminal, the terminal having a maximum outer diameter, the compression seal comprising a compressible main body having an inner diameter and an outer diameter wherein the compressible main body has a minimum inner diameter that is smaller than the maximum outer diameter of the terminal; wherein the compression seal is configured such that the coaxial, cable connector engages the terminal before the connector contacts the compressible main body and at least a portion of an inner surface of the compressible main body about halfway along its axial length has an inner diameter that is smaller when the compressible main body is in the axially compressed state as compared to the axially uncompressed state.

2. The compression seal of claim 1 wherein the terminal has an total axial length, and the compressible main body has a total axial length shorter than the total axial length of the terminal.

3. The compression seal of claim 1 wherein the compressible main body comprises a tapered flange disposed at an end of the compressible main body.

4. The compression seal of claim 1 wherein the compressible main body comprises a first tapered flange disposed at one end of the compressible main body, and wherein the compressible main body comprises a second tapered flange disposed at an opposite end of the compressible main body.

5. The compression seal of claim 1 wherein the compressible main body is axially compressible.

6. The compression seal of claim 1 wherein the compression seal is configured such that the coaxial cable connector compresses the compressible main body, wherein the coaxial cable connector threadedly engages the threaded portion, and wherein the coaxial cable connector threadedly engages the threaded portion before the connector compresses the compressible main body.

7. The compression seal of claim 1 wherein the compression seal is configured such that the connector threadedly engages the terminal before the connector compresses the compressible main body.

8. The compression seal of claim 1 wherein the compression seal further comprises an outer body, the outer body comprising an inner surface defining an opening therein configured to receive the main body.

9. The compression seal of claim 1 wherein the compressible main body comprises a bellows portion.

10. The compression seal of claim 9 wherein the bellows portion comprises a plurality of peaks having substantially equal first maximum outer diameters in an uncompressed state, and wherein the plurality of peaks have substantially equal second maximum outer diameters in a compressed state.

11. The compression seal of claim 10 wherein the first maximum outer diameters are substantially equal to the second maximum outer diameters.

12. The compression seal of claim 9 wherein the bellows portion comprises a plurality of valleys having substantially equal first minimum inner diameters in an uncompressed state, and wherein the plurality of valleys have substantially equal second minimum outer diameters in a compressed state.

13. The compression seal of claim 12 wherein the first minimum outer diameters are substantially equal to the second minimum outer diameters.

14. The compression seal of claim 1 wherein the terminal comprises a threaded portion.

15. The compression seal of claim 14 wherein the compression seal is configured such that the coaxial cable connector threadedly engages the threaded portion before the connector contacts the compressible main body.

16. A method of sealingly engaging a coaxial cable connector to a terminal, the method comprising:

sliding a main seal body having an inner diameter and an outer diameter onto the terminal; then, engaging the terminal with the connector without the connector contacting the main seal body; then, compressing the main seal body with connector;

wherein at least a portion of an inner surface of the main seal body about halfway along its axial length has an inner diameter that is smaller when the main seal body is in the compressed state as compared to the uncompressed state.

17. The compression seal of claim 1 wherein the compression seal is configured such that the coaxial cable connector compresses the compressible main body without engaging an axially parallel length of the compressible main body.

18. The method of claim 16 wherein the coaxial cable connector compresses the main seal body without engaging an axially parallel length of the main seal body.

* * * * *